United States Patent [19]

Berg

[11] Patent Number: 4,767,473

[45] Date of Patent: Aug. 30, 1988

[54] METHOD FOR IMPROVING THE DYNAMIC STRENGTH OF WHEEL DISKS OF VEHICLE WHEELS MADE OF HEAT-TREATABLE ALUMINUM ALLOYS

[75] Inventor: Otto Berg, Asker, Norway

[73] Assignee: Ardal Og Sunndal Verk A.S., Oslo, Norway

[21] Appl. No.: 802,219

[22] Filed: Nov. 26, 1985

[30] Foreign Application Priority Data

Nov. 27, 1984 [DE] Fed. Rep. of Germany ..... 3443226

[51] Int. Cl.[4] ..... C22F 1/04

[52] U.S. Cl. ..... 148/159; 266/114; 266/134

[58] Field of Search ..... 148/11.5 A, 12.7 A, 148/159; 266/134, 114

[56] References Cited

U.S. PATENT DOCUMENTS 2,596,345 5/1952 Penrod ..... 266/134

3,172,787 3/1965 Martenet ..... 148/11.5 A

*Primary Examiner*—R. Dean

*Attorney, Agent, or Firm*—Wenderoth, Lind & Ponack

[57] ABSTRACT

A vehicle wheel formed of a heat treatable aluminum alloy and including an axially center area and opposite axially end areas is subjected to a solution heat treatment and then is cooled in a controlled manner to improve the dynamic strength of the wheel. Specifically, cooling is achieved by cooling the center area faster than the end areas. More particularly, a cooling medium first is sprayed on the center area and then is sprayed on the end areas.

3 Claims, 1 Drawing Sheet

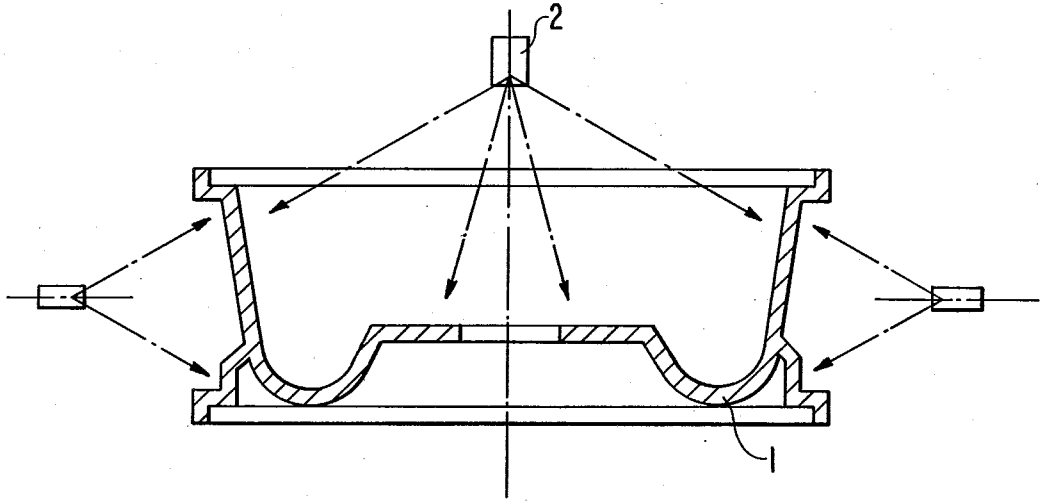
1
2

METHOD FOR IMPROVING THE DYNAMIC STRENGTH OF WHEEL DISKS OF VEHICLE WHEELS MADE OF HEAT-TREATABLE ALUMINUM ALLOYS

BACKGROUND OF THE INVENTION

The invention relates to a method of improving the dynamic strength of wheel disks of vehicle wheels made of heat-treatable alloys, as well as to apparatus for carrying out said method.

Aluminum vehicle wheels have a number of positive properties compared to conventional steel wheels. For example, they have a lower weight, better heat dissipation during braking, better balancing, and a more attractive appearance. Therefore, aluminum wheels have found increasingly wide application both in passenger and in commercial vehicles, in the latter case particularly in the United States.

The extent to which the weight of a wheel can be reduced, e.g., by using a thinner aluminum material, is limited by the dynamic strength of aluminum, which can be much lower than the strength measured under static conditions. Therefore, these are clear limits to the strength of worked material employed for wheels. This is especially applicable to a wheel disk, i.e., the central part of the wheel, which sometimes is subjected to considerable rotating of deflecting forces. Thus, the fatigue strength of aluminum determines to a large extent the dimensions and thereby the weight of the wheel. Up to a certain extent, the fatigue strength can be increased by using suitable alloys, but the gain is often insignificant.

Solution heat treatment such as, for example, described in "Robert B. Ross: Handbook of Metal Treatments and Testing, London", pp. 206–208, is known for improving the properties of worked material of various alloys, including aluminum alloys.

The use of solution heat treatment of wheel rims is also described in U.S. Pat. No. 3,172,787, in which wheel rims are manufactured from a continuously cast aluminum profile by appropriate rounding and welding. After completion of the welding seam, the rims are solution heat treated and then calibrated to the finished size and configuration. However, this prior art method includes no reference to the treatment of wheel disks in terms of their fatigue strength.

On the basis of the loads to which a wheel is subjected, the wheel disk i.e., the central part of the wheel, is manufactured from a work material which is approximately twice as strong as that of the rim. For the most common vehicle wheels, the strength of the wheel disk lies within the 7 to 14 mm range. During cooling or quenching in accordance with the solution heat treatment, the rim is cooled faster than the disk because of the thinner wall. The cooling in accordance with the solution heat treatment from approximately 550° C. to room temperature creates a relatively large heat leakage during the cooling. If this cooling is carried out without control, considerable stresses may occur as a result of a nonuniform cooling rate. These stresses are added to the dynamic loads to which the wheel is normally subjected.

SUMMARY OF THE INVENTION

The present invention has as its object the reduction of the wall thickness of vehicle wheel disks made of heat-treatable aluminum alloys and thereby of the weight thereof, without having to put up with a diminution in the dynamic strength thereof.

The method embodying the invention is characterized by the fact that, after the solution heat treatment, the wheel disk is cooled faster in a center area than at the edges. In this way, a temperature gradient can be attained between the center area and the edges, so that static compressive stresses occur in the part of the wheel in which the above fatigue stresses occur.

BRIEF DESCRIPTION OF THE DRAWING

Other objects, features and advantages of the present invention will be apparent from the following detailed description, with reference to the accompanying drawing, wherein:

The single FIGURE is a sectional view through a wheel treated according to the present invention.

DETAILED DESCRIPTION OF THE INVENTION

An embodiment of the invention will now be described with reference to the drawing which shows a section of a wheel which is to be cooled in a controllable manner. To this end, after shaping and solution heat treatment, the wheel 1 is sprayed with cooling water from nozzles 2, 3 and 4 to cool the wheel, from approximately 550° C. to room temperature. Other equipment such as, for example, devices for supporting the wheel 1 and the nozzle and for the supply of cooling water are not shown, since they would be understood by those skilled in the art.

The cooling water emerging from the nozzle 2 is controlled in such a way that it impinges, first, on the center area of the wheel. Then, a larger part of the wheel is progressively impinged upon by the cooling water until finally the rims, i.e., the axially opposite end areas of the wheel, also are sprayed with cooling water from the nozzles 3 and 4, but on a surface or side of the wheel opposite that surface of side thereof sprayed by nozzle 2.

In practice, the following procedure has proved effective. After the solution heat treatment at a temperature of 550° C., a wheel measuring 5½" J×15" is quenched with cold water.

Immediately after placing the hot wheel in a device (not shown) for supporting the wheel, the wheel interior is sprayed with water from the nozzle 2. After five seconds, another more axially outward area of the wheel is impinged upon by the cooling water. After another five seconds, finally the rim also is sprayed with water from the nozzles 3 and 4.

After approximately 20 seconds, the entire wheel is cooled down to room temperature, that is, it is fully quenched and can be removed from the support device.

The special feature of the invention for achieving satisfactory cooling is the fact that, during the cooling process, a temperature gradient exists between the center part of the disk of the wheel and the rim thereof which is at the highest temperature. In this way, compressive stresses occur in the disk both in tangential and in radial directions. In special cases, this method can produce compressive stresses of a magnitude corresponding to non-deformability.

I claim:

1. In a method of treating a vehicle wheel formed of a heat-treatable aluminum alloy and including an axially center area and axially end areas on opposite sides of said center area, wherein said wheel is subjected to a solution heat treatment and then is cooled, the improvement comprising improving the dynamic strength of said wheel by conducting said cooling such that said center area is cooled faster than said end areas.

2. The improvement claimed in claim 1, comprising first cooling said center area and then cooling said end areas.

3. The improvement claimed in claim 2, wherein said end areas extend substantially radially of said center area, and said cooling comprises first spraying a cooling medium on said center area on one side of said wheel, and then spraying the cooling medium on said end areas on an opposite side of said wheel, thereby forming a radially extending temperature gradient within said wheel between said center area and said end areas.

* * * * *